US007612504B2

(12) United States Patent
Ballenger et al.

(10) Patent No.: US 7,612,504 B2
(45) Date of Patent: Nov. 3, 2009

(54) LAMP WITH INTEGRAL VOLTAGE CONVERTER HAVING PHASE-CONTROLLED DIMMING CIRCUIT FOR REDUCING RMS LOAD VOLTAGE

(75) Inventors: Matthew B. Ballenger, Lexington, KY (US); George B. Kendrick, Lexington, KY (US)

(73) Assignee: OSRAM SYLVANIA Inc., Danvers, MA (US)

( * ) Notice: Subject to any disclaimer, the term of this patent is extended or adjusted under 35 U.S.C. 154(b) by 991 days.

(21) Appl. No.: 10/967,746

(22) Filed: Oct. 16, 2004

(65) Prior Publication Data

US 2006/0082326 A1 Apr. 20, 2006

(51) Int. Cl.
*H05B 37/00* (2006.01)

(52) U.S. Cl. ..... 315/245; 315/194; 315/291; 315/244

(58) Field of Classification Search ..... 315/245
See application file for complete search history.

(56) References Cited

U.S. PATENT DOCUMENTS

| | | | | | |
|---|---|---|---|---|---|
| 3,609,402 | A | | 9/1971 | Ferro | 307/252 M |
| 3,869,631 | A | | 3/1975 | Anderson et al. | 313/217 |
| 4,224,563 | A | | 9/1980 | Hardy | 323/225 C |
| 4,977,346 | A | * | 12/1990 | Gibson et al. | 313/25 |
| 4,988,921 | A | | 1/1991 | Ratner et al. | 315/159 |
| 5,055,742 | A | * | 10/1991 | Jurell et al. | 315/94 |
| 5,083,255 | A | * | 1/1992 | Nilssen | 363/132 |
| 5,144,205 | A | * | 9/1992 | Motto et al. | 315/244 |
| 5,231,627 | A | * | 7/1993 | Paul et al. | 369/125 |
| 5,892,391 | A | | 4/1999 | Hughes | 327/79 |
| 6,037,722 | A | * | 3/2000 | Moisin | 315/307 |
| 6,445,133 | B1 | | 9/2002 | Lin et al. | 315/57 |
| 6,690,040 | B2 | * | 2/2004 | Chaudhry et al. | 257/135 |
| 6,727,665 | B2 | | 4/2004 | Yao | 315/247 |
| 6,870,327 | B2 | * | 3/2005 | Takahashi et al. | 315/248 |

* cited by examiner

*Primary Examiner*—Hung T Vy
*Assistant Examiner*—Binh V Ho
(74) *Attorney, Agent, or Firm*—Shaun P. Montana

(57) ABSTRACT

An incandescent lamp includes a lamp voltage conversion circuit within the lamp and connected to a lamp terminal, where the voltage conversion circuit converts a first line voltage at the lamp terminal to a second RMS load voltage usable by a light emitting element of the lamp. The voltage conversion circuit includes a triac phase-controlled dimming circuit, which in turn includes a voltage controlled resistor that varies a resistance in the phase-controlled dimming circuit as the first voltage varies so as to maintain the second voltage substantially constant. The voltage conversion circuit may be an integrated circuit that is in the lamp base and connected between the lamp terminal and the light emitting element.

8 Claims, 5 Drawing Sheets

LAMP WITH INTEGRAL VOLTAGE CONVERTER HAVING PHASE-CONTROLLED DIMMING CIRCUIT FOR REDUCING RMS LOAD VOLTAGE

BACKGROUND OF THE INVENTION

The present invention is directed to a lamp with an integral voltage converter that converts line voltage to a voltage suitable for lamp operation.

Some lamps operate at a voltage lower than a line (or mains) voltage of, for example, 120V or 220V, and for such lamps a voltage converter that converts line voltage to a lower lamp operating voltage must be provided. The voltage converter may be provided in a fixture to which the lamp is connected or within the lamp itself. U.S. Pat. No. 3,869,631 is an example of the latter, in which a diode is provided in the lamp base for clipping the line voltage to reduce RMS load voltage at the light emitting element. U.S. Pat. No. 6,445,133 is another example of the latter, in which transformer circuits are provided in the lamp base for reducing the load voltage at the light emitting element.

Factors to be considered when designing a voltage converter that is to be located within the lamp include the sizes of the lamp and voltage converter, costs of materials and production, production of a potentially harmful DC load on a source of power for installations of multiple lamps, and the operating temperature of the lamp and an effect of the operating temperature on a structure and operation of the voltage converter.

SUMMARY OF THE INVENTION

An object of the present invention is to provide a novel lamp that includes within the lamp a voltage converter for converting line voltage to a lower RMS load voltage, where the voltage converter includes a triac phase-controlled dimming circuit.

The phase-controlled dimming circuit may also include a voltage controlled resistor (VCR) that varies a resistance in the phase-controlled dimming circuit as line voltage at the lamp terminal varies. For example, the triac phase-controlled dimming circuit may include a capacitor, a diac, a triac that is triggered by the diac, and a junction field effect transistor VCR.

The voltage converter may be an integrated circuit in a lamp base and connected between a lamp terminal and a light emitting element housed in the lamp light transmitting envelope.

DESCRIPTION OF PREFERRED EMBODIMENTS

Figure 1:
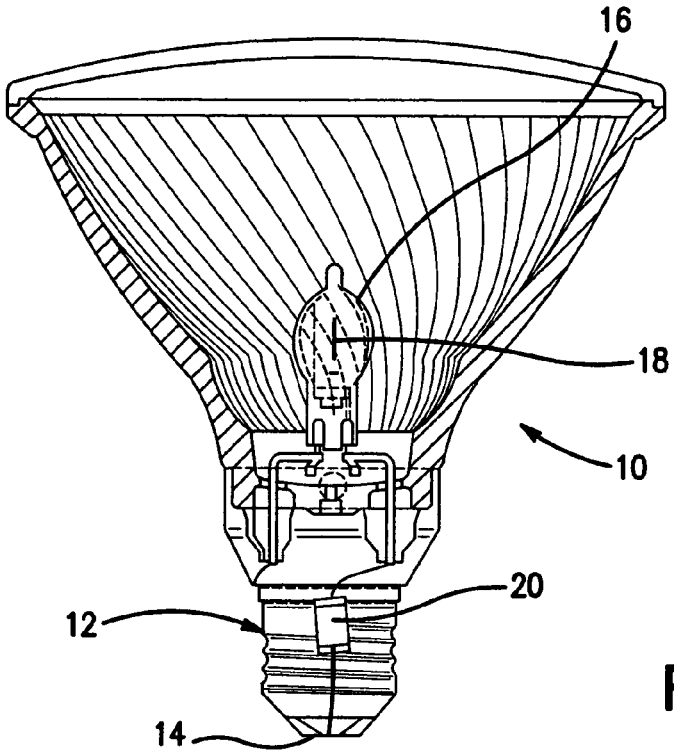
FIG. 1 is a partial cross section of an embodiment of a lamp of the present invention.

With reference to FIG. 1, a lamp 10 includes a base 12 with a lamp terminal 14 that is adapted to be connected to line (mains) voltage, a light-transmitting envelope 16 attached to the base 12 and housing a light emitting element 18 (an incandescent filament in the embodiment of FIG. 1), and a lamp voltage conversion circuit 20 for converting a line voltage at the lamp terminal 14 to a lower lamp operating voltage. The lamp voltage conversion circuit 20 is within the base 12 and connected between the lamp terminal 14 and the light emitting element 18. The voltage conversion circuit 20 may be an integrated circuit in a suitable package as shown schematically in FIG. 1.

While FIG. 1 shows the lamp voltage conversion circuit 20 in a parabolic aluminized reflector (PAR) halogen lamp, the lamp voltage conversion circuit 20 may be used in any incandescent lamp when placed in series between the light emitting element (e.g., filament) and a connection (e.g., lamp terminal) to a line voltage.

Figure 2:
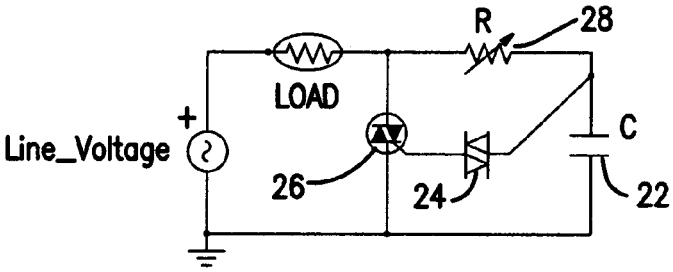
FIG. 2 PRIOR ART
FIG. 2 is a schematic circuit diagram of a phase-controlled dimming circuit of the prior art.

The voltage conversion circuit 20 includes a phase-controlled dimming circuit, derived from a conventional phase-controlled dimming circuit such as shown in FIG. 2 that has a capacitor 22, a diac 24, a triac 26 that is triggered by the diac 24, and resistor 28. In a conventional dimming circuit, the resistor 28 may be a potentiometer that sets a resistance in the circuit to control a phase at which the triac 26 fires. A dimming circuit is a two terminal device intended to reside in series with a relatively small resistive load.

Figure 3:
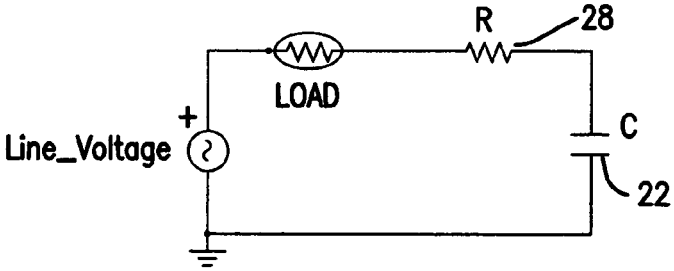
FIG. 3 PRIOR ART
FIG. 3 is a schematic circuit diagram of the phase-controlled dimming circuit of FIG. 2 showing an effective state in which the triac is not yet triggered.

In operation, a dimming circuit such as shown in FIG. 2 has two states. In the first state the diac 24 and triac 26 operate in the cutoff region where virtually no current flows. Since the diac and triac function as open circuits in this state, the result is an RC series network such as illustrated in FIG. 3. Due to the nature of such an RC series network, the voltage across the capacitor 22 leads the line voltage by a phase angle that is determined by the resistance and capacitance in the RC series network. The magnitude of the capacitor voltage is also dependent on these values.

Figure 4:
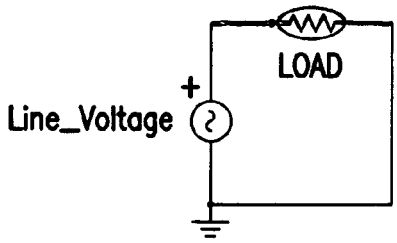
FIG. 4 PRIOR ART
FIG. 4 is a schematic circuit diagram of the phase-controlled dimming circuit of FIG. 2 showing an effective state in which the triac has been triggered.

The voltage across the diac 24 is analogous to the voltage drop across the capacitor 22 and thus the diac will fire once breakover voltage is achieved across the capacitor. The triac 26 fires when the diac 24 fires. Once the diac has triggered the triac, the triac will continue to operate in saturation until the diac voltage approaches zero. That is, the triac will continue to conduct until the line voltage nears zero crossing. The virtual short circuit provided by the triac becomes the second state of the dimming circuit, such as illustrated in FIG. 4.

Figure 5:
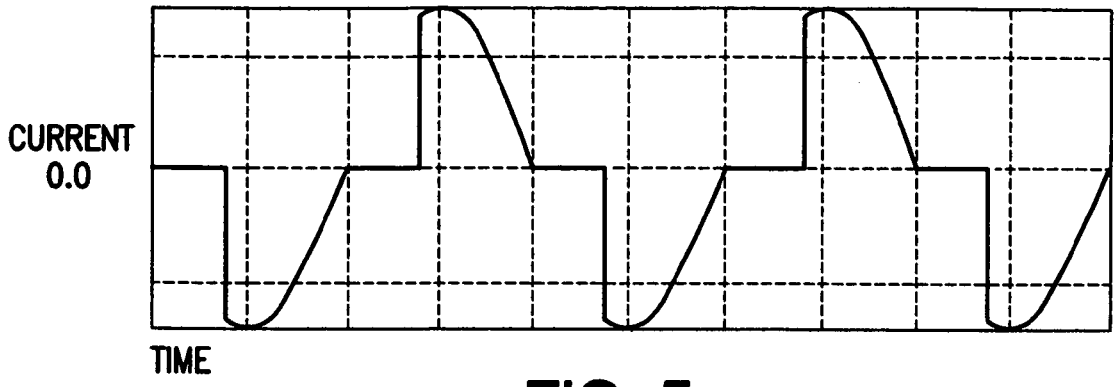
FIG. 5 PRIOR ART
FIG. 5 is a graph illustrating current clipping in the phase-controlled dimming circuit of FIG. 2.
Figure 6:
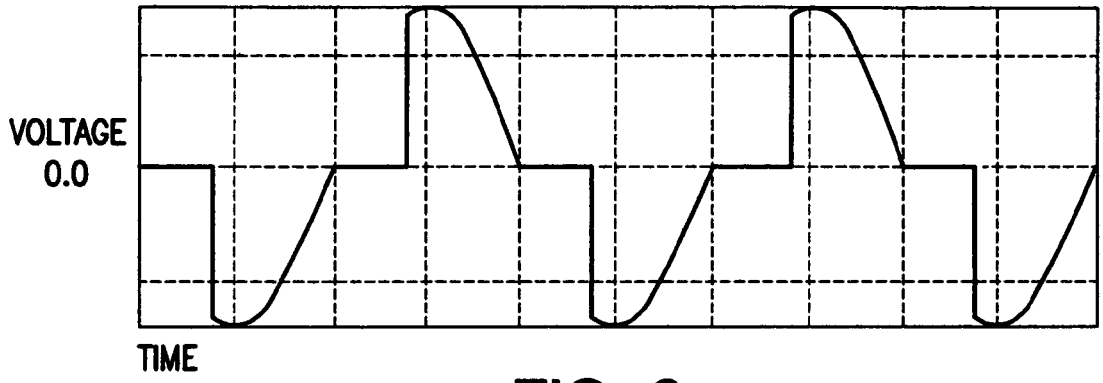
FIG. 6 PRIOR ART
FIG. 6 is a graph illustrating voltage clipping in the phase-controlled dimming circuit of FIG. 2.

Triggering of the triac 26 in the dimming circuit is phase-controlled by the RC series network and the leading portion of the mains voltage waveform is clipped until triggering occurs, as illustrated in FIGS. 5-6. A load attached to the dimming circuit experiences this clipping in both voltage and current due to the relatively large resistance in the dimming circuit.

Accordingly, the RMS load voltage and current are determined by the resistance and capacitance values in the dimming circuit since the phase at which the clipping occurs is determined by the RC series network and since the RMS voltage and current depend on how much energy is removed by the clipping.

Line voltage may vary from location to location up to about 10% and this variation can cause a variation in RMS load voltage in the lamp by an amount that can vary light levels, shorten lamp life, or even cause immediate failure. For example, if line voltage were above the standard for which the voltage conversion circuit was designed, the triac 26 may trigger early thereby increasing RMS load voltage. In a halogen incandescent lamp, it is particularly desirable to have a constant RMS load voltage. As will be explained below, there are several options for dealing with this problem.

Figure 7:
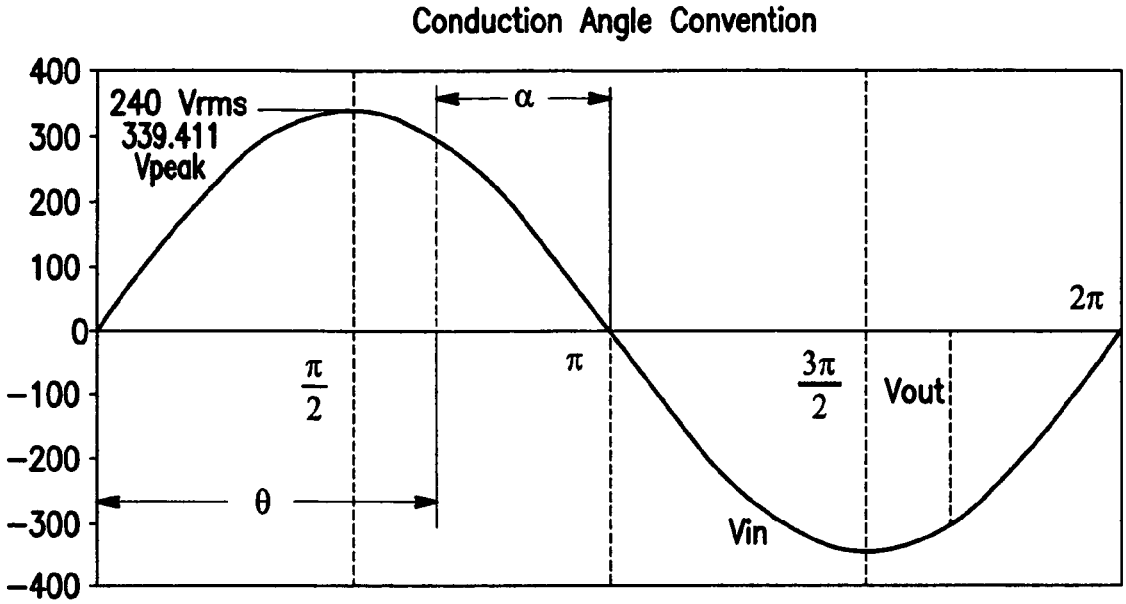
FIG. 7 is a graph showing the conduction angle convention adopted herein.

By way of background and with reference to FIG. 7, clipping is characterized by a conduction angle a and a delay angle θ. The conduction angle is the phase between the point on the load voltage/current waveforms where the triac begins conducting and the point on the load voltage/current waveform where the triac stops conducting. Conversely, the delay angle is the phase delay between the leading line voltage zero crossing and the point where the triac begins conducting.

Define $V_{irrms}$ as RMS line voltage, $V_{ip}$ as peak line voltage, $V_{orms}$ as RMS load voltage, $V_{op}$ as peak load voltage, T as period, and ω as angular frequency (rad) with ω=2πf. The RMS voltage is determined from the general formula:

$$V_{orms} = \sqrt{\frac{1}{T}\int_0^T v^2(t)\,dt}$$

Applying the conduction angle defined above yields:

$$V_{orms} = \sqrt{\frac{1}{2\pi}\left[\int_{\pi-\alpha}^{\pi} V_{ip}^2\sin^2(\omega)\,d\omega + \int_{2\pi-\alpha}^{2\pi} V_{ip}^2\sin^2(\omega)\,d\omega\right]}$$

$$V_{orms} = \sqrt{\frac{1}{2\pi}(2)\left[\int_{\pi-\alpha}^{\pi} V_{ip}^2\sin^2(\omega)\,d\omega\right]}$$

$$V_{orms} = \sqrt{\frac{V_{ip}^2}{\pi}\left(\frac{\alpha - \sin\alpha\cos\alpha}{2}\right)}$$

$$V_{orms} = V_{ip}\sqrt{\frac{\alpha - \sin\alpha\cos\alpha}{2\pi}}$$

This relationship can also be used to define $V_{ip}$ in terms of $V_{orms}$ and α:

$$V_{ip} = V_{orms}\sqrt{\frac{2\pi}{\alpha - \sin\alpha\cos\alpha}}$$

Figure 8:
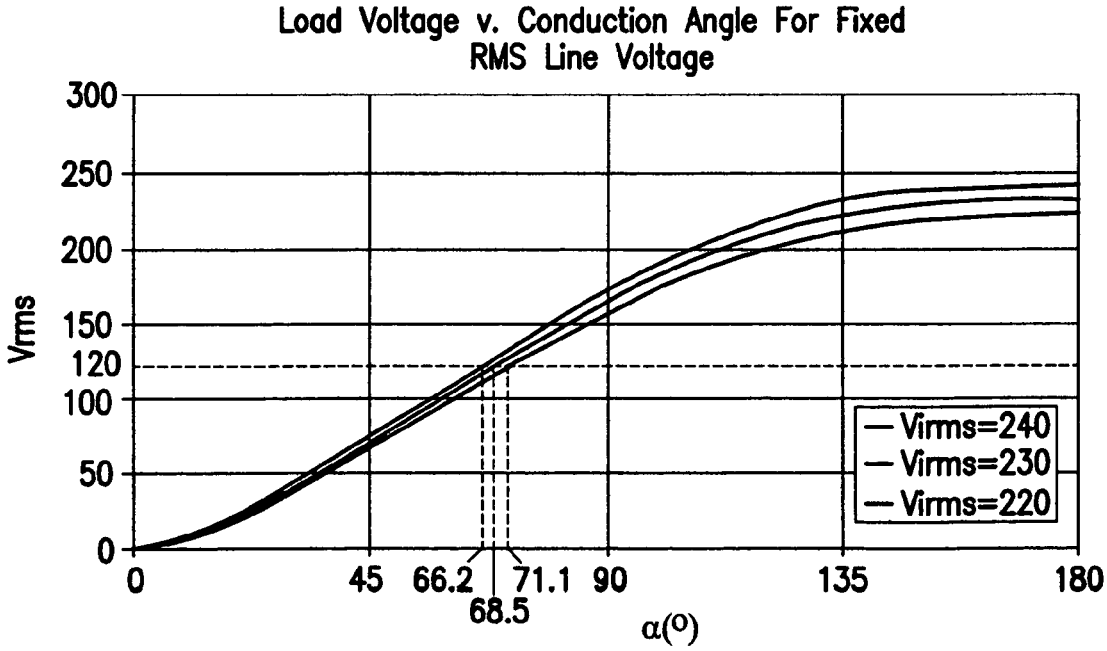
FIG. 8 is a graph showing the relationship of load voltage to conduction angle for several RMS line voltages.
Figure 9:
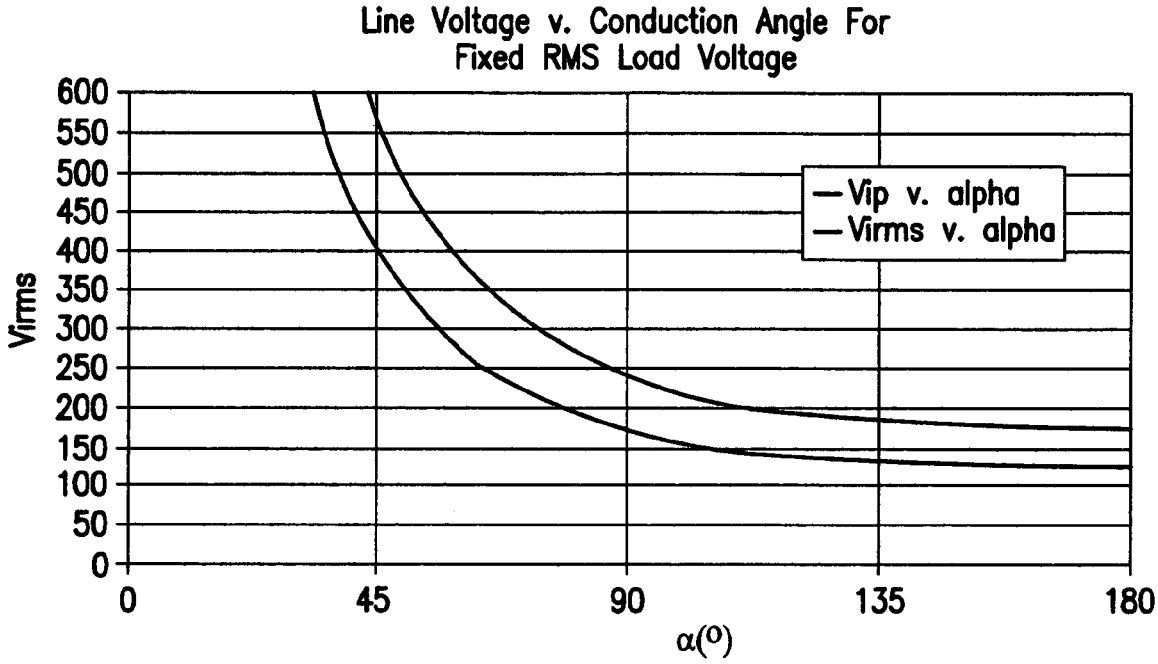
FIG. 9 is a graph showing the relationship of line voltage to conduction angle for fixed RMS load voltages.

Using these equations, the relationship between peak line voltage, RMS line voltage, RMS load voltage, and conduction angle α may be displayed graphically. FIG. 8 shows $V_{orms}$ as a function of conduction angle α for line voltages 220V, 230V and 240V. Note that small changes in line voltage result in larger changes in RMS load voltage. FIG. 9 shows the relationship of line voltage to conduction angle for fixed RMS load voltages. A lamp light emitting element (e.g., filament) is designed to operate at a particular load voltage, such as 120 Vrms. As seen these graphs, the conduction angle required to achieve this load voltage depends on the RMS line voltage and the relationship is not linear. Changes in the line voltage are exaggerated at the load.

Figure 10:
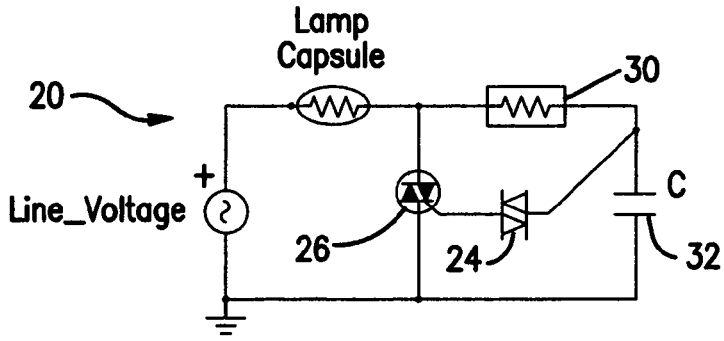
FIG. 10 is a schematic circuit diagram of a phase-controlled dimming circuit of an embodiment of the present invention.

With reference to FIG. 10, one option for solving the problem of varying line voltages is to design different voltage conversion circuits for particular line voltages and to incorporate the different circuits in a family of lamps that are each sold for use with a particular line voltage. Since line voltage does not vary very much at a particular location, particular lamps with particular voltage conversion circuits could be provided for particular locations once the line voltage for the location is known. Each voltage conversion circuit would include an RC series network with a resistance element 30 and a capacitor 32 whose resistance and capacitance would be selected, based on the anticipated line voltage, to provide a conduction angle that provides the RMS load voltage appropriate for the lamp. For example, the RC values in one circuit could be optimized for 220V operation, another circuit for 230V and so on. Line frequency (50 Hz and 60 Hz) also needs to be considered as the line frequency also affects circuit performance.

By way of further explanation, recall that the conduction angle of triac triggering is dependent on the RC series portion of the dimming circuit. When selecting the resistance and capacitance for voltage conversion circuits for a family of lamps, it is preferable to pick an appropriate capacitance and optimize the resistance. Consider how varying resistance affects triggering. In a simple RC series circuit (e.g., FIG. 3), the circuit resistance $R_T$ will be load resistance plus the resistance of the resistor. In application, the load resistance is very small compared to the resistance of the resistor and may be ignored. Using Kirchoff's voltage law the line source voltage $V_s$ can be written in terms of loop current I and element impedances:

$$V_s = I\left[R_T + \frac{1}{j\omega C}\right]$$

which may be rewritten:

$$I = \frac{j\omega C V_s}{j\omega R_T + 1}$$

This equation may be used to write an expression for the voltage across the capacitor:

$$V_C = I\frac{1}{j\omega C} = \frac{j\omega C V_s}{j\omega R_T C + 1}\left[\frac{1}{j\omega C}\right] = \frac{V_s(1 - j\omega R_T C)}{\omega^2 R_T^2 C^2 + 1}$$

The magnitude and phase relation of capacitor voltage with respect to reference line voltage can be calculated:

$$\mathrm{Im}\{V_c\} = \frac{-V_s\omega R_t C}{\omega^2 R_T^2 C^2 + 1}$$

$$\mathrm{Re}\{V_c\} = \frac{V_S}{\omega^2 R_T^2 C^2 + 1}$$

$$|V_C| = \sqrt{\mathrm{Im}^2\{V_C\} + \mathrm{Re}^2\{V_C\}} = \frac{V_S}{\sqrt{\omega^2 R_T^2 C^2 + 1}}$$

$$\angle\Theta_C = \tan^{-1}\left[\frac{\mathrm{Im}\{V_C\}}{\mathrm{Re}\{V_C\}}\right] = \tan^{-1}(-\omega R_T C)$$

The equations for capacitor voltage magnitude and phase delay show how the value of $R_T$ affects triggering. Diac triggering occurs (and thus triac triggering also occurs) when $V_C$ reaches diac breakover voltage. If capacitance and circuit frequency are fixed values, then $R_T$ and $V_S$ are the only variables that will affect the time required for $V_C$ to reach the diac breakover voltage. Accordingly, an appropriate resistance may be selected for each voltage conversion circuit in the family of lamps for different line voltages $V_S$.

Figure 11:
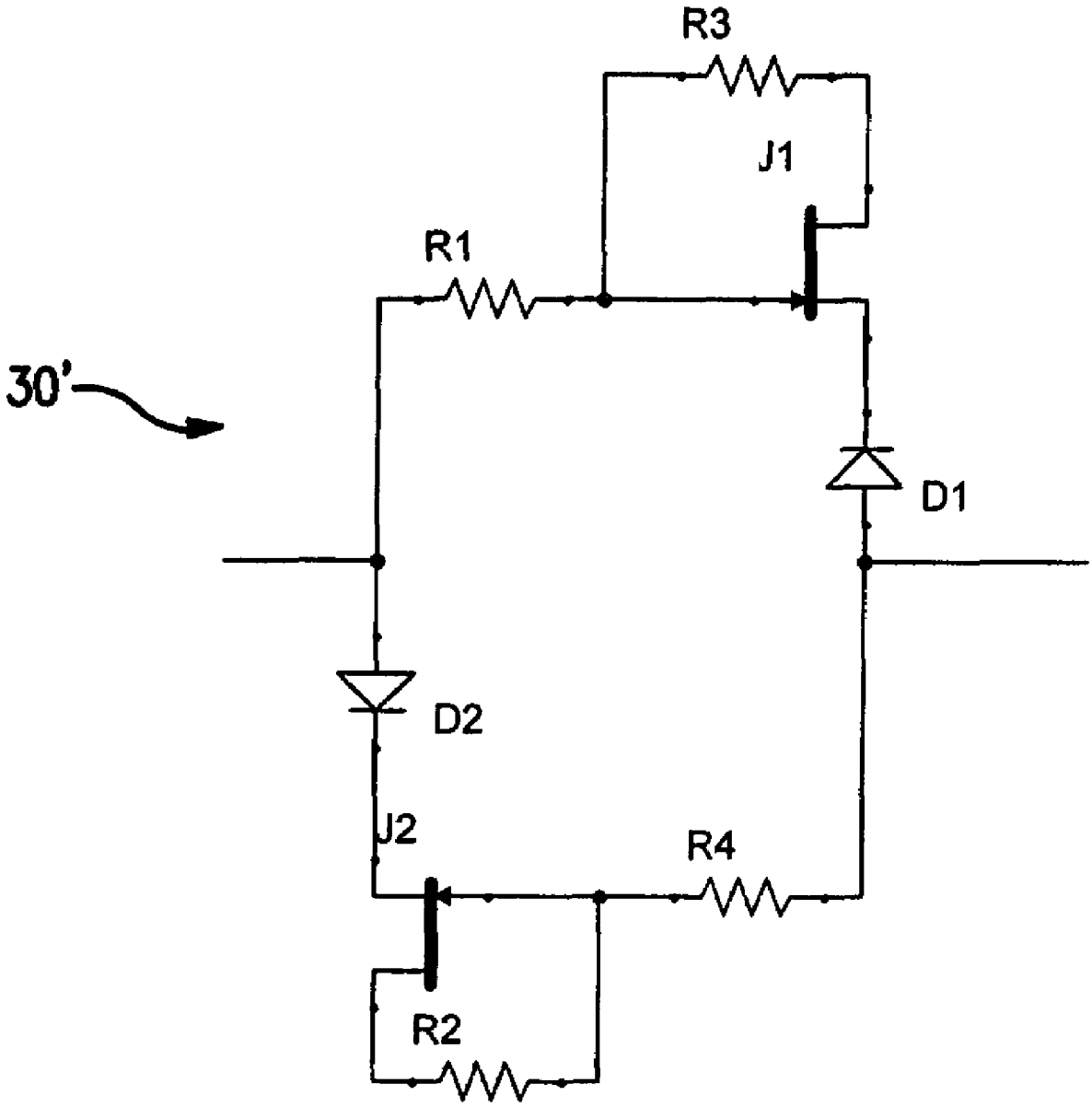
FIG. 11 is a schematic circuit diagram of a JFET voltage controlled resistor.

Another option for dealing with various line voltages is to modify the dimming circuit to provide load voltage regulation for the voltage control circuit so that one voltage conversion circuit will work in diverse locations where the line voltages may differ. The resistance element 30 (FIG. 10) may be a voltage controlled resistor (VCR) 30', which adjusts circuit resistance in response to changes in line voltage and thereby changes the clipping phase. An example of VCR 30' is the junction field effect transistor (JFET) VCR shown in FIG. 11. The VCR in FIG. 11 comprises JFETs J1, J2, resistors R1, R2, R3, R4 and diodes D1, D2. If line voltage increases, VCR 30' increases resistance to delay triggering the triac 26. Conversely, if line voltage decreases, VCR 30' decreases resistance to advance triggering the triac 26. That is, VCR 30' varies resistance in the phase-controlled dimming circuit in response to variations in the line voltage at the lamp terminal 14.

In a first embodiment, the lamp includes a lamp voltage converter, such as conversion circuit 20, in the lamp 10 and connected between lamp terminal 14 and light emitting element 18. The voltage converter converts a first line voltage at the lamp terminal 14 to a load voltage that operates the light emitting element, and includes phase-controlled dimming means for reducing an RMS load voltage at the light emitting element. The dimming means includes the dimming circuit discussed above and equivalents thereof.

A resistance in the dimming means may be fixed and based on the particular line voltage where the lamp is to be used.

Alternatively, the resistance in the dimming means may vary with the line voltage to provide a stable RMS load voltage. To this end, the phase-controlled dimming means may include means for varying a resistance in the voltage converter in reaction to variation of the first line voltage. This means for varying a resistance includes the VCR circuit 30' discussed above and equivalents thereof. The VCR varies a resistance in the phase-controlled dimming circuit when the first voltage varies so as to maintain the RMS load voltage substantially constant (for example, as determined by the constancy required by the incandescent resistive element in the light emitting element).

In a second embodiment, the lamp includes voltage conversion circuit 20 within the lamp 10 and connected to lamp terminal 14, where the voltage conversion circuit includes a phase-controlled dimming circuit that has voltage controlled resistor 30' that varies a resistance in the phase-controlled dimming circuit responsive to variation of voltage at the lamp terminal. The phase-controlled dimming circuit may also include capacitor 22, diac 24, and triac 26, and the VCR may be a junction field effect transistor VCR. The voltage conversion circuit may be an integrated circuit, which may be within the lamp base.

In a third embodiment, an incandescent lamp 10 includes base 12 with lamp terminal 14, light-transmitting envelope 16 attached to base 12 and housing light emitting element 18, and lamp voltage conversion circuit 20 for converting a first line voltage at the lamp terminal to a second RMS load voltage lower than the first voltage and that operates the light emitting element. The lamp voltage conversion circuit is within the base and connected between the lamp terminal and the light emitting element. The voltage conversion circuit includes a phase-controlled dimming circuit that has capacitor 22, diac 24, triac 26, and a voltage controlled resistor 30' that varies a resistance in the phase-controlled dimming circuit when the first voltage varies so as to maintain the second voltage substantially constant.

While embodiments of the present invention have been described in the foregoing specification and drawings, it is to be understood that the present invention is defined by the following claims when read in light of the specification and drawings.

We claim:

1. A lamp comprising a lamp voltage converter in the lamp and connected between a lamp terminal and a light emitting element, said voltage converter converting a first line voltage at said lamp terminal to a load voltage that operates said light emitting element, said voltage converter including phase-controlled dimming means for reducing an RMS load voltage at said light emitting element, said phase-controlled dimming means includes means for varying a resistance in said voltage converter in reaction to variation of the first line voltage.

2. The lamp of claim 1, wherein said phase-controlled dimming means comprises a circuit that has a resistor, a capacitor, a diac, and a triac that is triggered by said diac.

3. The lamp of claim 2, wherein said resistor has a resistance that is fixed and that is based on the first line voltage.

4. The lamp of claim 2, wherein said resistor has a resistance that varies in response to variation of the first line voltage so as to maintain the RMS load voltage substantially constant.

5. The lamp of claim 1 wherein said means for varying a resistance comprises a voltage controlled resistor that varies a resistance in said phase-controlled dimming circuit when the first line voltage varies so as to maintain the RMS load voltage substantially constant.

6. An incandescent lamp comprising:

a base with a lamp terminal;

a light-transmitting envelope attached to said base and housing a light emitting element; and a lamp voltage conversion circuit for converting a first line voltage at said lamp terminal to a second RMS load voltage lower than the first line voltage and that operates said light emitting element, said lamp voltage conversion circuit being within said base and connected between said lamp terminal and said light emitting element, said voltage conversion circuit including a phase-controlled dimming circuit that has a capacitor, a diac, a triac that is triggered by said diac, and a voltage controlled resistor that varies a resistance in said phase-controlled dimming circuit when the first line voltage varies so as to maintain the second voltage substantially constant.

7. The incandescent lamp of claim 6, wherein said voltage controlled resistor (VCR) is a junction field effect transistor VCR.

8. The incandescent lamp of claim 6, wherein said voltage conversion circuit is an integrated circuit.

* * * * *